US008684131B1

(12) United States Patent
Park et al.

(10) Patent No.: US 8,684,131 B1
(45) Date of Patent: Apr. 1, 2014

(54) DUAL MUFFLER

(71) Applicant: Kia Motors Corporation, Seoul (KR)

(72) Inventors: Ki Chul Park, Gyeonggi-do (KR); Dong Sun Kim, Chungcheongbuk-do (KR)

(73) Assignee: Kia Motors Corporation, Seoul (KR)

( * ) Notice: Subject to any disclaimer, the term of this patent is extended or adjusted under 35 U.S.C. 154(b) by 0 days.

(21) Appl. No.: 13/796,279

(22) Filed: Mar. 12, 2013

(30) Foreign Application Priority Data

Dec. 12, 2012 (KR) ..... 10-2012-0144958

(51) Int. Cl.

| | |
|---|---|
| ***F01N 13/08*** | (2010.01) |
| ***F01N 1/10*** | (2006.01) |
| *F01N 13/00* | (2010.01) |
| *F01N 1/00* | (2006.01) |

(52) U.S. Cl.
USPC ..... 181/228; 181/239; 181/272

(58) Field of Classification Search
USPC ..... 181/228, 238, 239, 272, 251, 256, 257, 181/252, 243
See application file for complete search history.

(56) References Cited

U.S. PATENT DOCUMENTS

| | | | | | |
|---|---|---|---|---|---|
| 701,496 | A | * | 6/1902 | McKinnie | 96/381 |
| 706,844 | A | * | 8/1902 | Motsinger | 181/239 |
| 2,382,159 | A | * | 8/1945 | Klemm | 181/241 |
| 2,692,025 | A | * | 10/1954 | Maxim | 181/238 |
| 2,879,861 | A | * | 3/1959 | Belsky et al. | 181/239 |
| 2,985,252 | A | * | 5/1961 | Morrish et al. | 181/239 |
| 2,990,028 | A | * | 6/1961 | Powers | 181/238 |
| 3,142,354 | A | * | 7/1964 | Kammerer et al. | 181/252 |
| 3,388,769 | A | * | 6/1968 | Martoia | 181/238 |
| 3,771,315 | A | * | 11/1973 | Scott | 60/297 |
| 3,794,139 | A | * | 2/1974 | Hetherington et al. | 181/238 |
| 4,064,963 | A | * | 12/1977 | Kaan et al. | 181/244 |
| 4,203,502 | A | * | 5/1980 | Strader | 181/238 |
| 4,760,894 | A | * | 8/1988 | Harwood et al. | 181/282 |
| 4,909,347 | A | * | 3/1990 | Wang | 181/272 |
| 5,477,015 | A | * | 12/1995 | Preslicka et al. | 181/282 |
| 5,559,308 | A | * | 9/1996 | Hayashi | 181/265 |
| 5,773,770 | A | * | 6/1998 | Jones | 181/268 |
| 6,241,044 | B1 | * | 6/2001 | Nishiyama et al. | 181/272 |
| 6,382,347 | B1 | * | 5/2002 | Gerber | 181/227 |
| 6,382,348 | B1 | * | 5/2002 | Chen | 181/239 |

(Continued)

FOREIGN PATENT DOCUMENTS

| | | | | |
|---|---|---|---|---|
| DE | 3837677 | A1 * | 6/1989 | F01N 1/04 |
| DE | 3807948 | A1 * | 9/1989 | F01N 1/04 |

(Continued)

*Primary Examiner* — Edgardo San Martin
(74) *Attorney, Agent, or Firm* — Edwards Wildman Palmer LLP; Peter F. Corless

(57) ABSTRACT

A dual muffler is provided which includes an inlet pipe, an end of which an exhaust gas is introduced from an engine. Additionally, an outlet pipe, an end of which is connected to an opposite end of the inlet pipe, branched at the opposite end of the inlet pipe running toward a side and the opposite side such that the exhaust gas from the inlet pipe is discharged through an opposite end is also provided. A housing covers the inlet pipe and the outlet pipe to expose the end of the inlet pipe and the opposite end of the outlet pipe to an outside environment; and a sound-absorbing material fills the interior space of the housing except for the remaining space where the inlet pipe and the outlet pipe.

6 Claims, 4 Drawing Sheets

(56) References Cited

U.S. PATENT DOCUMENTS

| | | | | |
|---|---|---|---|---|
| 6,467,572 | B1 * | 10/2002 | Liu | 181/272 |
| 7,104,359 | B1 * | 9/2006 | Zelinski | 181/264 |
| 7,562,741 | B2 * | 7/2009 | Winklel et al. | 181/239 |
| 7,712,578 | B2 * | 5/2010 | Han | 181/272 |
| 7,810,609 | B2 * | 10/2010 | Sikes et al. | 181/250 |
| 7,878,300 | B2 * | 2/2011 | Sammut et al. | 181/249 |
| 8,051,949 | B2 * | 11/2011 | Henke et al. | 181/251 |
| D664,906 | S * | 8/2012 | Lucas | D12/194 |
| 2009/0000863 | A1 * | 1/2009 | Kuo | 181/256 |
| 2011/0061969 | A1 * | 3/2011 | Hill et al. | 181/239 |

FOREIGN PATENT DOCUMENTS

| | | | | |
|---|---|---|---|---|
| JP | 02099709 | A * | 4/1990 | F01N 1/04 |
| JP | 03189316 | A * | 8/1991 | F01N 1/10 |
| KR | 10-2008-0028140 | | 3/2008 | |

* cited by examiner

DUAL MUFFLER

CROSS-REFERENCE TO RELATED APPLICATION

This application claims under 35 U.S.C. §119(a) the benefit of Korean Patent Application No. 10-2012-0144958 filed on Dec. 12, 2012, the entire contents of which are incorporated herein by reference.

BACKGROUND (a) Technical Field

The present invention relates to a dual muffler, and more particularly, to a dual muffler that emits a sporty exhaust sound and minimizes heat transfer of exhaust gas to the surroundings of the dual muffler.

(b) Background Art

In general, a muffler is a device that reduces noise generated from an internal combustion engine, and requires a balanced design to satisfy all noise effects and engine output because resistance against exhaust gas flow increases to reduce the engine output when the noise effect increases.

Meanwhile, in order to implement an exhaust sound that provides a more sporty sound of the dual muffler, it is important to reduce high frequency noise as much as possible and to increase rumble noise in within a low frequency and middle frequency bandwidth properly.

FIG. 1 shows the structure of an existing dual muffler including a plurality of baffles 2 in a housing 1 to partition the internal space of the housing 1 into a plurality of chambers 3*a*, 3*b*, 3*c*, 3*d*, and 3*e*. An end of an inlet pipe 4 is located in the fifth chamber 3*e* while the inlet pipe 4 penetrates the third chamber 3*c* formed in the center of the housing 1 and the fourth chamber 3*d* neighboring the third chamber 3*c*, and ends of an auxiliary pipe 5 penetrating the second chamber 3*b* are located in the first chamber 3*a* and the third chamber 3*c*, respectively. Ends of a first outlet pipe 6*a* penetrating the first chamber 3*a* and the second chamber 3*b* are located on a side of the housing 1 and on the third chamber 3*c*, and ends of a second outlet pipe 6*b* penetrating the fourth chamber 3*d* and the fifth chamber 3*e* are located on the opposite side of the housing 1 and on the third chamber 3*c*.

That is, exhaust gas introduced through the inlet pipe exits the fourth chamber, passes through the third chamber, and then exits into a tail pipe through the first outlet pipe and the second outlet pipe. However, in existing dual muffler rumble noise is not enough to implement a really effective sport like sound because the exhaust noise is dampened and weakened by expansion and interference while the exhaust gas passes through the fourth and third chambers.

Moreover, since the first chamber, the third chamber, and the fourth chamber are regions exposed directly to the exhaust gas, the third and fourth chambers, particularly, are on the path through which the exhaust gas flows and thus heat transferred to components surrounding the housing such as the trunk and a bumper. These components over time could become damaged from the heat.

The above-described background art is intended only for understanding of background of the present invention, but should not be considered as an already known prior art to one of ordinary skill in the art.

SUMMARY

The present invention has been made in an effort to solve the above-described problems associated with prior art. An object of the present invention is to provide a dual muffler that provides a sporty exhaust sound and minimizes heat transfer from the exhaust to gas to surroundings of the muffler.

In one aspect, the present invention provides a dual muffler including: an inlet pipe, an end of which an exhaust gas is introduced from an engine; an outlet pipe, an end of which is connected to an opposite end of the inlet pipe, branched at the opposite end of the inlet pipe running toward a side and the opposite side of the dual muffler so that the exhaust gas from the inlet pipe is discharged through an opposite end; a housing surrounding the inlet pipe and the outlet pipe to expose the end of the inlet pipe and the opposite end of the outlet pipe to an outside environment; and a sound-absorbing material provided in the housing to fill up the interior space of the housing except for the remaining space where the inlet pipe and the outlet pipe are provided.

The inlet pipe may have a punching aperture formed on the circumference. The outlet pipe may have a punching aperture formed on the circumference. The inlet pipe and the outlet pipe at the side and the opposite side of the dual muffler may be connected to each other by a 'Y'-shaped connector pipe. The outlet pipe at the end and the opposite side may be made by connecting a plurality of pipes in series.

The muffler may further include a baffle installed by being inserted into the housing, so that the internal space of the housing may be partitioned. The outlet pipe may also penetrate the baffle.

The baffle may have a punching aperture formed in a middle region thereof. The baffles may be provided at the side and the opposite side of the housing symmetrically about the inlet pipe. A plurality of the baffles is provided in the housing, and the outlet pipe may to be made by connecting a plurality of pipes in series so that one baffle only penetrates each pipe. Additionally, the sound-absorbing material may be glass fiber.

BRIEF DESCRIPTION OF THE DRAWINGS

The above and other features of the present invention will now be described in detail with reference to certain exemplary embodiments thereof illustrated in the accompanying drawings which are given herein below by way of illustration only, and thus are not limitative of the present invention, and wherein.

Figure 1:
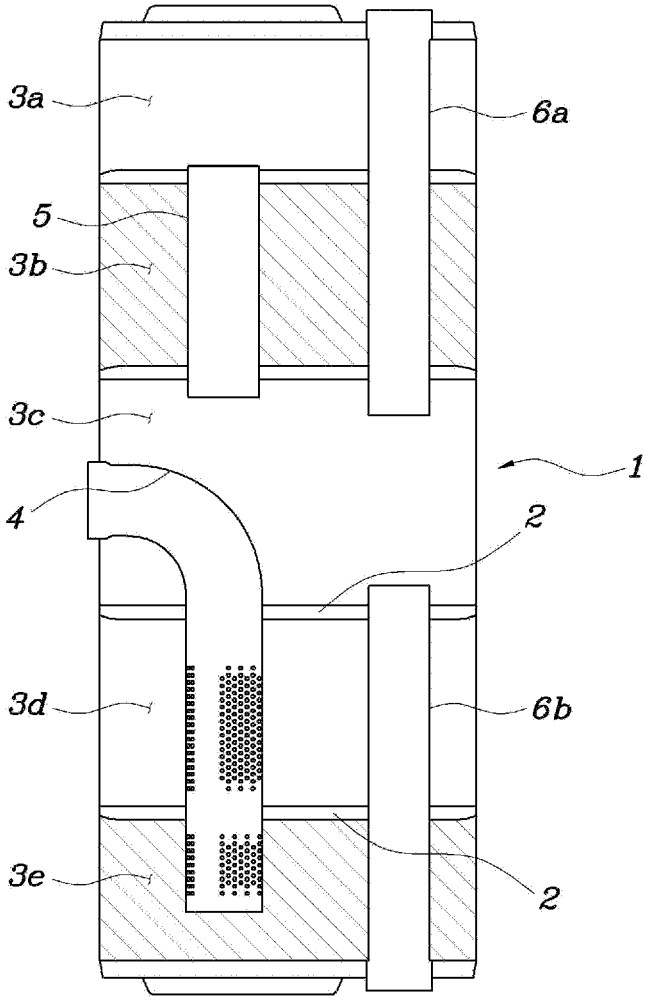
FIG. 1 PRIOR ART
FIG. 1 is a sectional view showing a dual muffler according to the related art.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, a dual muffler according to an exemplary embodiment of the present invention will be described with reference to the accompanying drawings.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Figure 2:
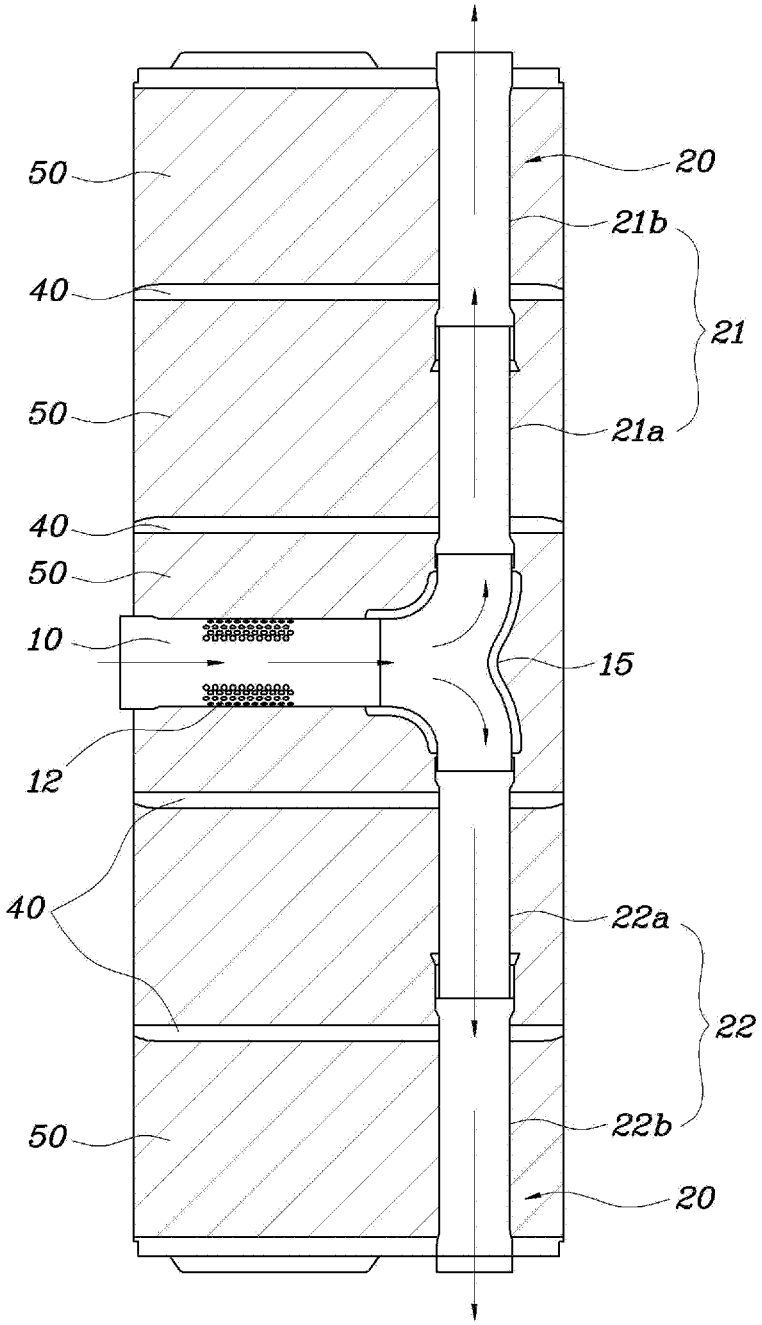
FIG. 2 is a sectional view showing punching apertures formed through an inlet pipe of a dual muffler according to an exemplary embodiment of the present invention.
Figure 3:
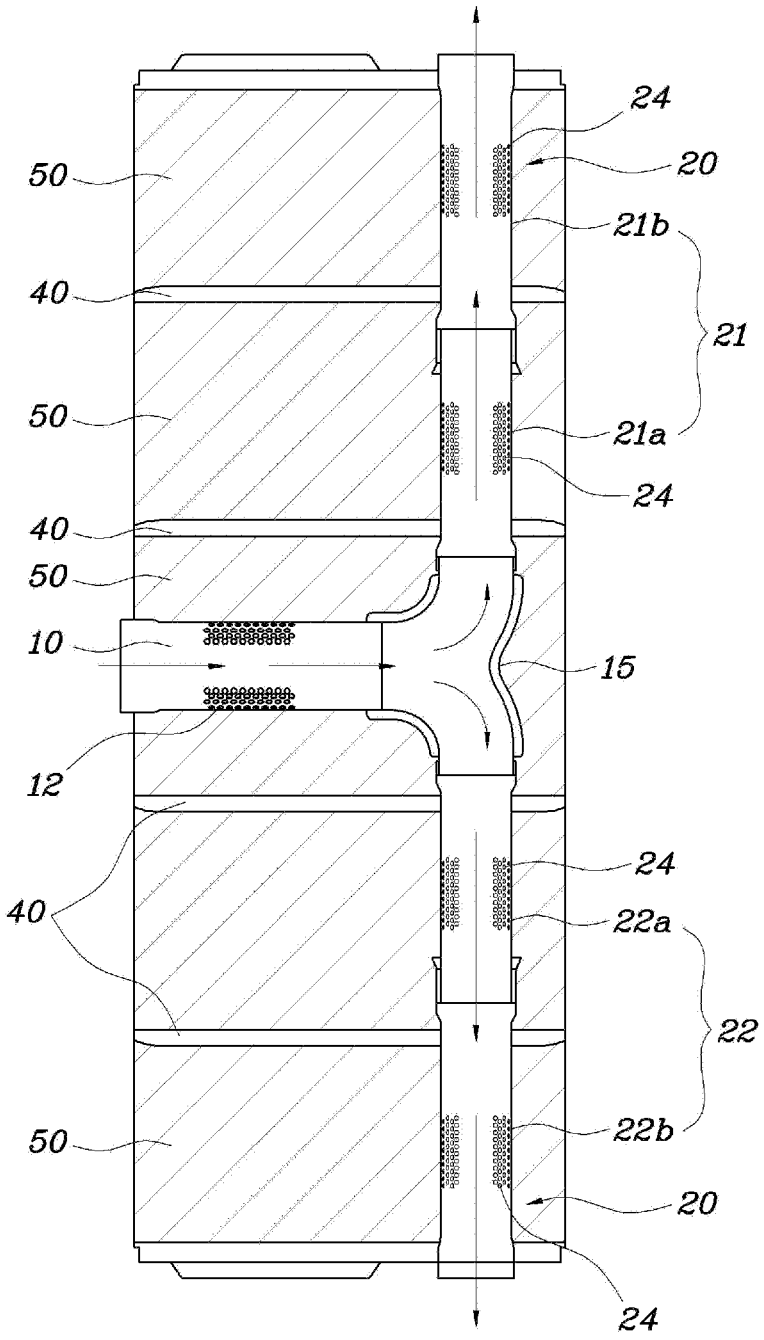
FIG. 3 is a sectional view showing punching apertures formed through an inlet pipe and an outlet pipe of the dual muffler according to an exemplary embodiment of the present invention.

FIG. 2 is a sectional view showing punching apertures formed through an inlet pipe of a dual muffler according to an exemplary embodiment of the present invention, and FIG. 3 is a sectional view showing punching apertures formed through on an inlet pipe and an outlet pipe of the dual muffler according to an exemplary embodiment of the present invention. A dual muffler according to an exemplary embodiment of the present invention may include an inlet pipe 10, an outlet pipe 20, a housing 30, and a sound-absorbing material 50.

Referring to FIGS. 2 and 3, considering overall configuration of the dual muffler according to the exemplary embodiment of the present invention, the dual muffler may include: an inlet pipe 10, an end of which exhaust gas is introduced from an engine; outlet pipes 20, an end of which is connected to an opposite end of the inlet pipe 10, branched at the opposite end of the inlet pipe 10 running toward a side and the opposite side such that the exhaust gas from the inlet pipe 10 is discharged through opposite ends of the outlet pipe; a housing 30 provided in a shape of covering the inlet pipe 10 and the outlet pipes 20 exposing the end of the inlet pipe 10 and the opposite ends of the outlet pipes 20 to the outside; and a sound-absorbing material 50 provided in the housing 30 to fill up the interior space of the housing 30 except for the remaining space where the inlet pipe 10 and the outlet pipes 20 are provided.

In addition to the above description, first the inlet pipe 10 has an end connected to the engine, through which the exhaust gas discharged from the engine is introduced, and the introduced exhaust gas is discharged into the outlet pipes 20 connected to the inlet pipe 10.

Here, as illustrated in FIG. 2, the inlet pipe 10 may have a plurality of punching apertures 12 along the circumference. Moreover, as illustrated in FIG. 3, the outlet pipe 20 as well as the inlet pipe 10 may have a plurality of punching apertures 24 along the circumference. Thus, the high frequency noise in the exhaust noise is reduced and the exhaust noise is tuned with a low noise in low and middle frequency bands.

The outlet pipes 20 includes a first outlet pipe 21 and a second outlet pipe 22, while ends of the first outlet pipe 21 and the second outlet pipe 22 are connected to the opposite end of the inlet pipe 10. The first outlet pipe 21 is branched from the opposite end of the inlet pipe 10 by about 90 degrees in an first direction and the second outlet pipe 22 is branched to from the opposite end of the inlet pipe 10 toward the opposite side, that is, by about 90 degrees in a second opposite direction, so that the exhaust gas introduced from the inlet pipe 10 is discharged through the opposite ends of the first and second outlet pipes 21 and 22.

Here, the inlet pipe 10, the first outlet pipe 21, and the second outlet pipe 22 may be connected by a Y-shaped connector pipe to entirely form a connection in a 'T'-shape. That is, since the connector pipe forms a 'Y'-shape, the internal space from the inlet pipe 10 to the first outlet pipe 21 and the second outlet pipe 22 does not expand. Thus, the sporty exhaust sound can be achieved more efficiently.

In addition, both the first outlet pipe 21 and the second outlet pipe 22 may be formed by connecting a plurality of pipes in series, respectively. That is, the first outlet pipe 21 may be made by connecting a first intake pipe 21*a* and a first outtake pipe 21*b* and the second outlet pipe 22 may be made by connecting a second intake pipe 22*a* and a second outtake pipe 22*b*.

In this case, an end of the first intake pipe 21*a* and an end of the second intake pipe 22*a* may be connected to the connector pipe, and the opposite end of the first intake pipe 21*a* and the opposite end of the second intake pipe 22*a* may be separately connected to an end of the first outtake pipe 21*b* and an end of the second outtake pipe 22*b*, and the opposite end of the first outtake pipe 21*b* and the opposite end of the second outtake pipe 22*b* may be exposed to both sides of the housing 30. Thus, the outlet pipe 20 is made by connecting the two pipes, so that it is possible to prevent damage to the outlet pipe 20 from thermal deformation during thermal expansion due to an ambient temperature difference between the outlet pipe 20 and the muffler.

The housing 30 may surround or cover the inlet pipe 10 and the outlet pipes 20 while exposing the end of the inlet pipe 10 through which the exhaust gas is introduced and the opposite end of the outlet pipes 20 through which the exhaust gas is exhausted. Here, baffles 40 are inserted into the housing 30 to partition the internal space of the housing 30 into a plurality of chambers. Since the baffles 40 are inserted into the housing 30, the outlet pipes 20 penetrate the baffles 40.

Figure 4:
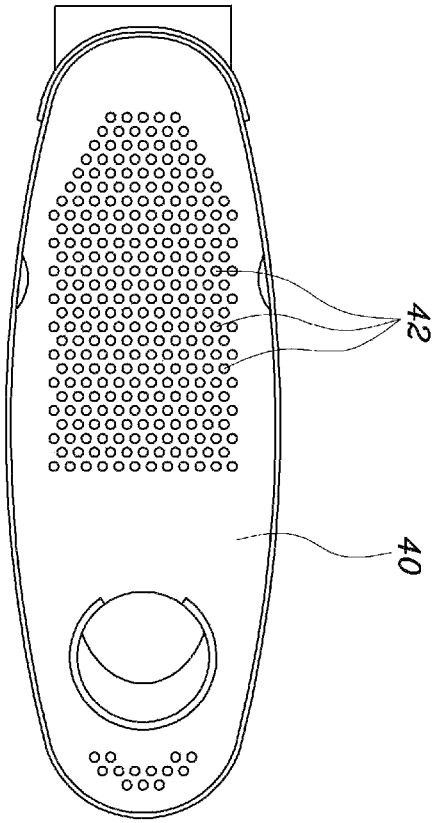
FIG. 4 is a view showing configuration of a baffle according to the exemplary embodiment of the present invention.

FIG. 4 shows configuration of the baffles 40. Referring to FIG. 4, the baffles 40 may have punching apertures 42 formed at the middle region thereof, such that the punching apertures 42 reduce booming noise of very low frequency band, which is propagated outside a path through which the exhaust gas flows. In addition, the baffles 40 may be provided at an internal side and opposite side of the housing 30 symmetrically about the inlet pipe 10. That is, stiffness of the housing 30 can be guaranteed and reflective noise and allophone can be minimized by the baffles 40.

Moreover, as described above, a plurality of the baffles 40 may be provided in the housing 30 and further the outlet pipe 20 may be made by connecting a plurality of pipes in serial, so that only one baffle 40 may be inserted into each pipe. That is, the baffles 40 are inserted through the first intake pipe 21*a* and the first outtake pipe 21*b* forming the first outlet pipe 21 one by one and the baffles 40 are inserted through the second intake pipe 22*a* and the second outtake pipe 22*b* forming the second outlet pipe 22, so that the outlet pipes 20 can be connected and separated easily.

The sound-absorbing material 50 may be filled up in the housing 30, particularly in the internal space of the housing 30 except for the space where the inlet pipe 10 and the outlet pipes 20 are provided. In this case, the sound-absorbing material 40 may be glass wool acting as glass fiber. That is, since the sound-absorbing material 50 is filled within the internal space of the housing 30 except for the space through which the inlet pipe 10 and the outlet pipe 20 pass, the high frequency noise is reduced and temperature discharged to the outside can be remarkably decreased, so that ambient temperature around the muffler can be reduced.

As such, the dual muffler according to the present invention, in comparison to the dual muffler according to the related art, provides a sporty exhaust sound, particularly an exhaust sound within the range of about 200 Hz to 400 Hz, i.e., the critical frequency band of the sporty exhaust sound, due to a more linear engine explosive sound. Moreover, according to the dual muffler of the present invention, noise of low frequency band at an oscillation region is reduced, noise higher than the low band is increased, and sporty rumble sound increases, so that the sporty exhaust sound can be maximized.

As described above, due to the sound-absorbing material within the internal space of the housing except for the remaining internal space where the inlet pipe and the outlet pipe are provided, heat is not discharged from the housing to the outside to decrease outside temperature of the muffler so that heat transfer to the ambient environment of the muffler can be minimized. Moreover, the punching apertures formed in the inlet pipe and the baffles together with the sound-absorbing material reduce high frequency bandwidth noise and low to frequency bandwidth noise within the oscillation region, while increasing noise that is higher than the low frequency band and increasing sporty rumble sound, so that the sporty exhaust sound can be maximized.

While the present invention has been illustrated and described with reference to specific embodiments, it is apparent to those skilled in the art to which the present invention pertains that the present invention may be variously improved and changed without departing from the scope of the present invention.

What is claimed is:

1. A dual muffler comprising:

an inlet pipe, an end of which an exhaust gas is introduced from an engine;

an outlet pipe, an end of which is connected to an opposite end of the inlet pipe, branched at the opposite end of the inlet pipe running toward a side and the opposite side such that the exhaust gas from the inlet pipe is discharged through opposite ends of the dual muffler;

a housing surrounding the inlet pipe and the outlet pipe to expose the end of the inlet pipe and the opposite end of the outlet pipe to an outside environment;

a plurality of baffles inserted into a side of the housing to partition an internal space of the housing wherein an outlet pipe is inserted through at least one of the baffles and at least one baffle is are provided symmetrically at each of the side and the opposite side of the housing about the inlet pipe; and a sound-absorbing material provided in the housing to fill the interior space of the housing except for the remaining space where the inlet pipe and the outlet pipe are provided, wherein a side of the inlet pipe and opposite sides of the outlet pipes are connected by a 'Y'-shaped connector pipe, wherein the outlet pipes at the side and the opposite side of the dual muffler are a plurality of pipes connected in a series.

2. The dual muffler of claim 1, wherein the inlet pipe has a punching aperture formed on the circumference.

3. The dual muffler of claim 1, wherein the outlet pipe has a punching aperture formed on the circumference.

4. The dual muffler of claim 1, wherein the baffle has a punching aperture formed in the middle region.

5. The dual muffler of claim 1, wherein only one baffle penetrates each pipe of the plurality of pipes connected in series.

6. The dual muffler of claim 1, wherein the sound-absorbing material is glass fiber.

* * * * *